US010414027B2

(12) United States Patent
Hammer et al.

(10) Patent No.: US 10,414,027 B2
(45) Date of Patent: Sep. 17, 2019

(54) METHOD FOR POSITIONING A COMPONENT AND COMPONENT POSITIONING DEVICE

(71) Applicant: Bayerische Motoren Werke Aktiengesellschaft, Munich (DE)

(72) Inventors: Maik Hammer, Bruckberg (DE); Johann Van Niekerk, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 60 days.

(21) Appl. No.: 15/214,682

(22) Filed: Jul. 20, 2016

(65) Prior Publication Data

US 2016/0325407 A1 Nov. 10, 2016

Related U.S. Application Data

(63) Continuation of application No. PCT/EP2015/053597, filed on Feb. 20, 2015.

(30) Foreign Application Priority Data

Mar. 26, 2014 (DE) ..... 10 2014 205 612

(51) Int. Cl.
*B25B 11/00* (2006.01)

(52) U.S. Cl.
CPC ..... *B25B 11/002* (2013.01); *B25B 11/00* (2013.01); *Y10T 29/49998* (2015.01); *Y10T 29/50* (2015.01)

(58) Field of Classification Search
CPC . B25B 11/002; B25B 11/00; Y10T 29/49998; Y10T 29/50
USPC ..... 29/559, 560; 269/56
See application file for complete search history.

(56) References Cited

U.S. PATENT DOCUMENTS 3,175,820 A 3/1965 Schiler
3,722,360 A * 3/1973 Blakey ..... B23Q 3/107 33/545
3,793,738 A * 2/1974 Blakey ..... G01B 3/00 33/501
4,360,974 A * 11/1982 de Cuissart ..... B23Q 1/545 33/567
4,390,172 A * 6/1983 Gotman ..... B23Q 1/5462 198/345.3
4,812,157 A * 3/1989 Smith ..... C03B 23/0252 65/273

(Continued)

FOREIGN PATENT DOCUMENTS

CN 102699606 A 10/2012
CN 103386656 A 11/2013

(Continued)

OTHER PUBLICATIONS

International Search Report (PCT/ISA/210) issued in PCT Application No. PCT/EP2015/053597 dated May 19, 2015 with English-language translation (four (4) pages).

(Continued)

*Primary Examiner* — Bayan Salone
(74) *Attorney, Agent, or Firm* — Crowell & Moring LLP

(57) ABSTRACT

A method is provided for positioning a component, in particular a sheet metal component, which has a first hole or a first recess. The component with the first hole or the first recess is placed on a first support which is spherical-shaped or shaped as a spherical cap.

9 Claims, 2 Drawing Sheets

(56) References Cited

U.S. PATENT DOCUMENTS

| | | | | |
|---|---|---|---|---|
| 7,686,287 | B2 * | 3/2010 | Dixon | B23Q 1/32 269/20 |
| 8,602,376 | B2 * | 12/2013 | Vogel | F16M 11/14 248/187.1 |
| 9,206,067 | B2 * | 12/2015 | Nitschke | C03B 35/207 |
| 2002/0148392 | A1 * | 10/2002 | Wells | A61C 9/0093 108/1 |
| 2005/0045779 | A1 * | 3/2005 | Nan | A61H 19/44 248/133 |
| 2008/0017764 | A1 * | 1/2008 | Nan | A61H 19/44 248/133 |
| 2008/0054541 | A1 * | 3/2008 | Dixon | B23Q 1/32 269/75 |
| 2012/0305733 | A1 * | 12/2012 | Vogel | F16M 11/14 248/371 |
| 2013/0071181 | A1 * | 3/2013 | Herzinger | B23K 37/0408 403/361 |
| 2013/0078855 | A1 * | 3/2013 | Hornick | H01R 13/73 439/571 |
| 2013/0185916 | A1 * | 7/2013 | Mantei | B23K 31/02 29/428 |
| 2014/0260431 | A1 * | 9/2014 | Nitschke | C03B 35/207 65/106 |
| 2016/0039706 | A1 * | 2/2016 | Nitschke | C03B 35/207 65/106 |

FOREIGN PATENT DOCUMENTS

| | | | | |
|---|---|---|---|---|
| DE | 33 08 733 | A1 | 9/1984 | |
| DE | 200 08 983 | U1 | 9/2001 | |
| DE | 602 14 067 | T2 | 1/2007 | |
| WO | WO 2012/171249 | A1 | 12/2012 | |
| WO | WO 2014/023987 | A1 | 2/2014 | |
| WO | WO 2014023987 | A1 * | 2/2014 | B25B 11/00 |

OTHER PUBLICATIONS

German-language Written Opinion (PCT/ISA/237) issued in PCT Application No. PCT/EP2015/053597 dated May 19, 2015 (five (5) pages).

German-language Office Action issued in counterpart German Application No. 10 2014 205 612.8 dated Dec. 2, 2014 (five (5) pages).

Chinese Office Action issued in counterpart Chinese Application No. 201580003396.8 dated Dec. 30, 2016 with English-language translation (fourteen (14) pages).

* cited by examiner

Fig. 3A
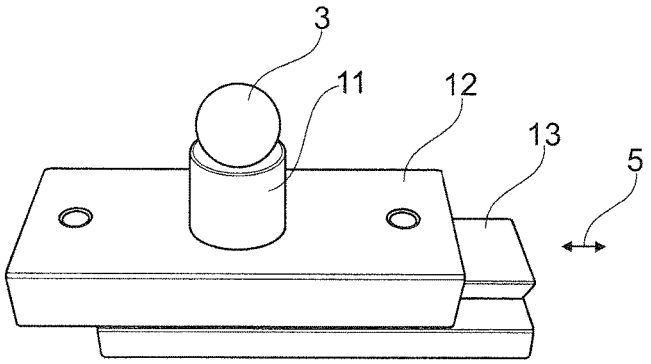
Fig. 3B
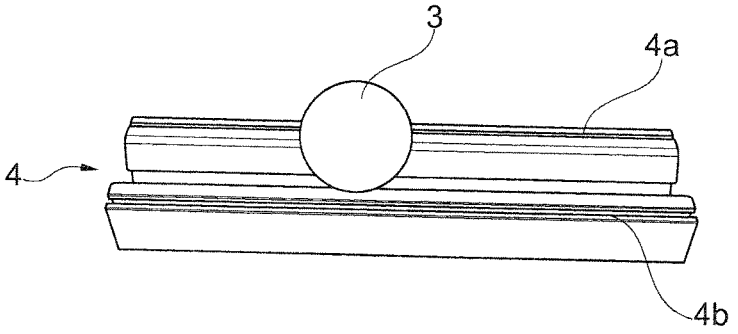
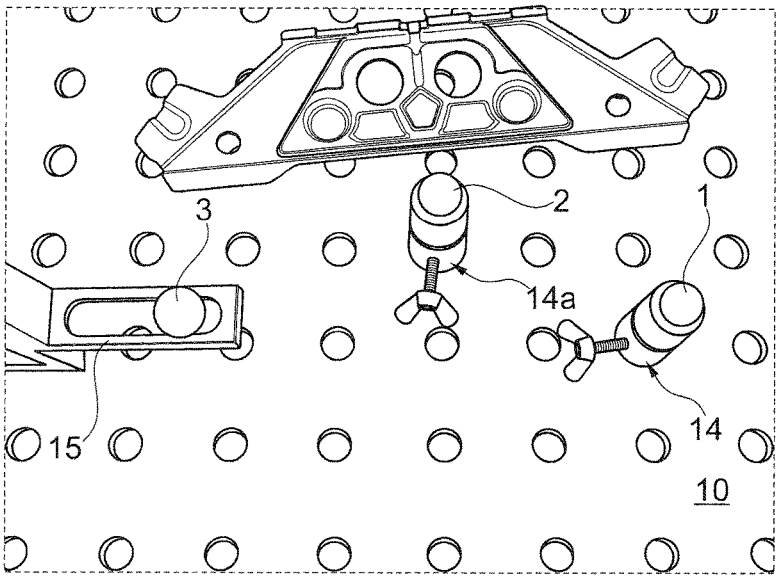
Fig. 4

METHOD FOR POSITIONING A COMPONENT AND COMPONENT POSITIONING DEVICE

CROSS REFERENCE TO RELATED APPLICATIONS

This application is a continuation of PCT International Application No. PCT/EP2015/053597, filed Feb. 20, 2015, which claims priority under 35 U.S.C. § 119 from German Patent Application No. 10 2014 205 612.8, filed Mar. 26, 2014, the entire disclosures of which are herein expressly incorporated by reference.

BACKGROUND AND SUMMARY OF THE INVENTION

The present invention relates to a method for positioning a component, particularly a sheet metal component which has a first hole or a first recess, as well as to a positioning device for such components.

In many applications, components have to be positioned in a spatially defined orientation in a simple and accurately repeatable manner.

It is an object of the invention to provide a method by which components, particularly sheet metal components, can be positioned in a spatially defined orientation in a particularly easily repeatable manner with high precision. It is a further object of the invention to create a positioning device that is suitable for this purpose.

An aspect of the invention is the idea of placing or supporting a component, which has a first hole or a first recess, by using a first support that is formed by a sphere or a spherical cap. In this case, it is a prerequisite that the diameter of the first hole or of the first recess is at least slightly smaller than the diameter of the sphere or of the spherical cap. By placing the first component onto the first support such that the first hole or the first recess is disposed on the sphere or the spherical cap, a bearing is obtained that is similar to a ball joint, i.e. the first component can be swiveled about the sphere or the spherical cap of the first support.

A spatially defined orientation of the component in the space will be obtained when the component additionally rests on a second and a third support.

According to a further aspect of the invention, the component has a second hole or a second recess and, by way of the second hole or the second recess, is placed on a second support, which is formed by a sphere or a spherical cap. Analogously to the first support, it is assumed here that the diameter of the second hole and of the second recess is at least somewhat smaller than the diameter of the sphere or of the spherical cap of the second support.

The first and/or the second hole or the first and/or the second recess may preferably be circular. However, this does not necessarily have to be the case. The first and/or the second hole may, for example, also have a triangular, quadrangular, pentagonal or any other polygonal design, in the form of a semicircle, a crescent or the like.

By placing the component in a third position of the component onto a third support, the component can be deposited in a spatially fixed manner in a defined fashion.

According to a further aspect of the invention, the first, the second and/or the third support is a magnetic support, i.e. a support that attracts ferromagnetic components, such as steel sheet components. By placing the component on a magnetic support, it is ensured that the component is attracted by the support. If the support is a sphere or a spherical cap, i.e. a magnet in the shape of a sphere or a spherical cap, and the component is placed onto the support by way of a hole provided in the component or a recess provided in the component, the component will automatically be centered with respect to the corresponding sphere or the spherical cap.

According to a further aspect of the invention it is provided that the first support is height-adjustable in a vertical direction and is adjusted to a predefined height before placing the component. In other words, the corresponding bearing point is pre-adjusted with respect to its height.

According to a further aspect of the invention, it is provided that the second support can be adjusted or displaced in a direction perpendicular to the vertical direction, i.e. in a transverse direction and, before the placing (or during the placing) of the component, is moved or displaced into a position, in which the second hole or the second recess comes to be situated on the second support.

It may further be provided that the second support can be displaced on a bearing rail, which is formed by two parallel rail side walls projecting in the vertical direction from a supporting table. If one of the supports is a sphere or a spherical cap, the latter can be disposed directly on the rail. In this case, it is essential that the diameter of the sphere or of the spherical cap is larger than the spacing of the rail side walls. If the second support is formed by a sphere, the latter can therefore be rolled directly on the rail side wall in the longitudinal direction of the bearing rail and can therefore be brought into a suitable position.

According to a further aspect of the invention, it is provided that the third support is also formed by a sphere or a spherical cap. If the third support is formed by a spherical cap, it may be provided that a flat side of the spherical cap of the third support rests from below against a bottom side of the component or the component rests on the flat side of the spherical cap.

It may be provided that the first, the second and/or the third support are arranged on a supporting table which has a hole grid, at least one of the supports being inserted into a hole of the hole grid.

As an alternative, a supporting table may also be used for the positioning of the supports, which supporting table has a regular "profiling", at least one of the supports being inserted into a recess of the profiling. The profiling may, for example, have a plurality of circular, triangular or polygonal trough-type recesses, which are arranged in a regular pattern, for example, in a hole grid, and which are provided for receiving a sphere or a spherical cap.

As an alternative or in addition, the supporting plate may also have a plurality of oblong trough-type recesses, which are arranged in a regular pattern and are provided for receiving or centering a sphere or spherical cap. For example, a plurality of mutually parallel or mutually perpendicular oblong recesses or a plurality of pairs of mutually parallel or mutually perpendicular oblong holes may be provided in the supporting plate, in which case a sphere or a spherical cap—similarly to the above-described supporting rail—, can be placed directly on or partially into such a recess or into such an oblong hole. Similarly to the case of a supporting rail, the sphere or spherical cap can be displaced in the longitudinal direction of the corresponding recess or of the corresponding oblong hole.

As a result of the invention, costly tensioning devices currently used in vehicle body construction can be avoided or their number can be reduced. The invention is suitable particularly for the positioning of components in small piece number (small-scale series). Components positioned according to the invention can be processed subsequently, for example, in that bolts, screws or the like are placed in the component.

Other objects, advantages and novel features of the present invention will become apparent from the following detailed description of one or more preferred embodiments when considered in conjunction with the accompanying drawings.

BRIEF DESCRIPTION OF THE DRAWINGS

FIGS. 3A and 3B are views of two variants of longitudinally displaceable supports.

FIG. 4 is a view of a supporting table equipped with a hole grid.

DETAILED DESCRIPTION OF THE DRAWINGS

Figure 1:
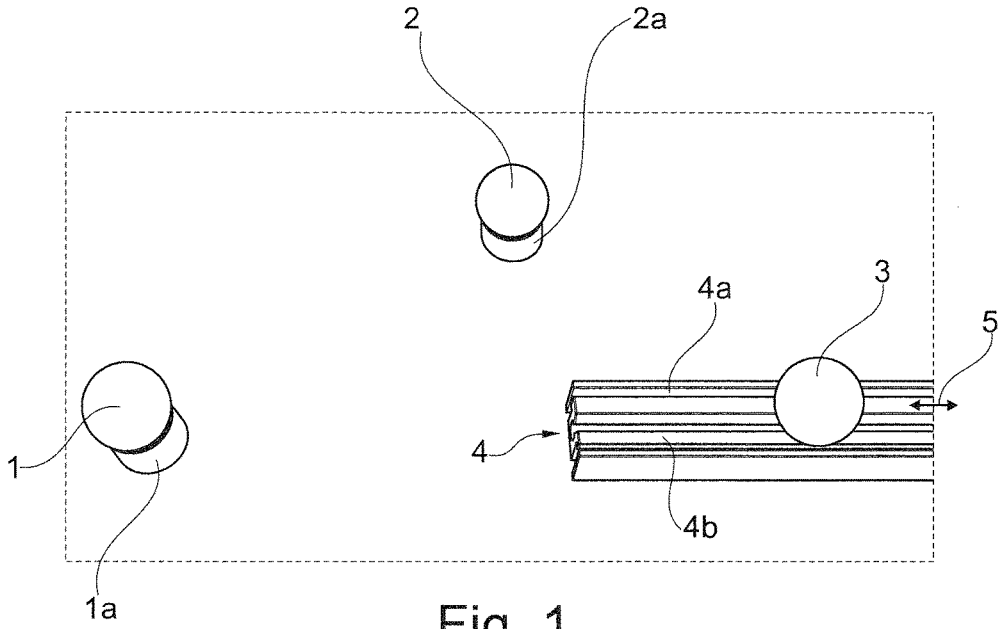
FIG. 1 is a view of three spheres provided as supports for a component.

FIG. 1 illustrates an arrangement of three steel balls 1, 2, 3. The two steel balls 1 and 2 are arranged in a spatially fixed manner on an assigned support base 1*a*, 2*a*. The support bases 1*a*, 2*a* each have the shape of a cylindrical ring whose diameter is smaller than that of the ball 1 and 2, respectively.

The ball 3 rests on a bearing rail formed by two parallel rail walls 4*a*, 4*b*. As illustrated in FIG. 1, the diameter of the ball 3 is larger than the spacing of the two rail walls 4*a*, 4*b*. The ball 3 can therefore be rolled or displaced in the longitudinal direction 5 of the bearing rail 4.

Figure 2:
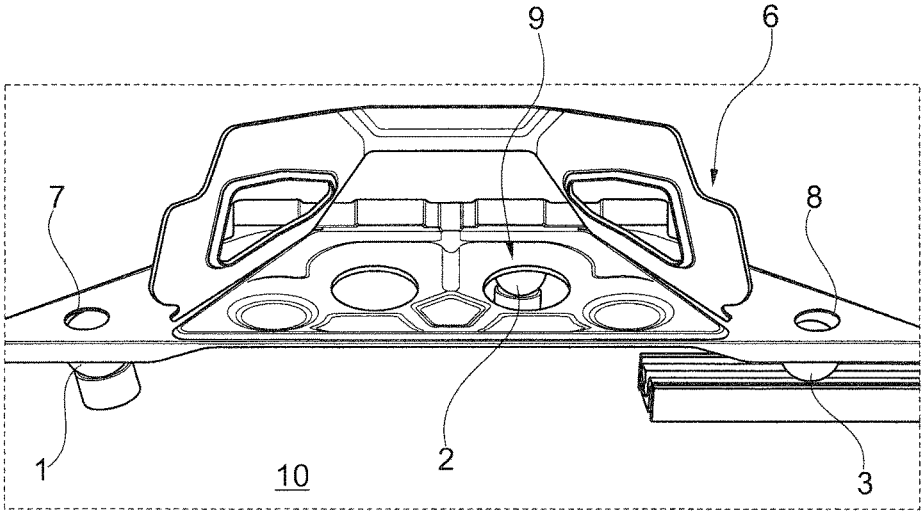
FIG. 2 is a view of a sheet metal component which is placed on the supports illustrated in FIG. 1.

FIG. 2 illustrates a steel or aluminum sheet component 6, in which a first circular hole 7 and a second circular hole 8 are provided. As shown in FIG. 2, the diameter of the holes 7, 8 is smaller than the diameter of the balls 1, 3. By means of its holes 7, 8, the component 6 is thereby disposed on the two balls 1, 3. Because the ball 3 is displaceable in the longitudinal direction of the supporting rail 7, 8, the component lies without any induced strains on the two balls 7, 8 such that the holes 7, 8 come to be centered with respect to the balls 1, 3. A rearward area 9 of the component 6 will lie on the ball 2.

Because the two balls 1, 2 are arranged in a spatially fixed manner with respect to a supporting table or a supporting plate 10 and the spacing of the two holes 7, 8 is predefined, a mere placing of the component 6 on the balls 1, 2, 3 can cause the component 6 to be moved in a very simple manner into a predefined spatial orientation. In this manner, components 6 can be aligned with high precision in an accurately repeatable manner in a defined direction in the space.

FIG. 3B is an enlarged view of the bearing rail 4 illustrated in FIG. 1.

As an alternative to the bearing rail 4, the ball 3 could also be arranged by way of a support base 11, which is fixedly connected with a slide block 12 as shown in FIG. 3A. The slide block 12 is longitudinally displaceable in the direction of the arrow 5 arranged on a supporting rail 13. The supporting rail 13 may be coupled with the slide block 12, for example, by way of a dovetail guide.

FIG. 4 illustrates a supporting table 10 which is equipped with a regular-distribution hole grid. In the case of the embodiment illustrated here, the supports 1, 2, 3 formed by the balls are fixed on the hole grid of the supporting table 10. The ball 1 can be adjusted in its height by way of a vertically adjustable holding element 14, i.e. in a direction perpendicular to the supporting table 10. In the same manner, the ball 2 can be adjusted in its height by way of a vertically adjustable adjusting element 14*a*. Here, the ball 3 can be displaced in the longitudinal direction of an oblong hole 15 provided in a supporting part.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of positioning a sheet component, the method comprising the acts of:

providing the sheet component with a first circular hole or a first circular recess having a hole or recess diameter;

resting the sheet component with the first circular hole or the first circular recess on a surface of a first support formed by a sphere or a spherical cap having a sphere or a spherical cap diameter larger than the hole or recess diameter.

2. The method according to claim 1, further comprising the acts of:

providing the sheet component with a second circular hole or a second circular recess having a second hole or recess diameter; and resting the sheet component, via the second circular hole or the second circular recess, on a surface of a second support formed by a sphere or a spherical cap having a sphere or a spherical cap diameter larger than the second hole or recess diameter.

3. A method of positioning a component, the method comprising the acts of:

providing the component with a first hole or a first recess having a first hole or first recess diameter and with a second hole or a second recess having a second hole or second recess diameter; and resting the component with the first hole or the first recess on a surface of a first support formed by a sphere or a spherical cap and, via the second hole or the second recess, on a surface of a second support formed by a sphere or a spherical cap, each of the spheres or spherical caps having a sphere or spherical cap diameter larger than both the first hole or first recess diameter and the second hole or second recess diameter;

wherein one or both of the first and second holes or the first and second recesses is circular.

4. The method according to claim 3, further comprising the act of:

placing the component onto a third support at a point of the component.

5. The method according to claim 4, wherein one or more of the first, second, or third supports is or are magnetic, whereby during the placing the component is attracted by the magnetic support.

6. The method according to claim 4, wherein the third support is formed by a sphere or a spherical cap.

7. The method according to claim 3, wherein the component is a sheet metal component.

8. A positioning device for positioning a component having a first circular hole or a first circular recess having a first diameter and a second circular hole or a second circular recess having a second diameter, the positioning device comprising:

at least a first support and a second support, each configured as a sphere or a spherical cap having a sphere or spherical cap diameter larger than the first and second diameters, wherein the component is placeable so as to rest by way of the first circular hole or the first circular recess and the second circular hole or the second circular recess of the component on surfaces of the first and second supports.

9. The positioning device according to claim 8, wherein the positioning device comprises three supports, each of which is formed by a sphere or a spherical cap.

* * * * *